US006151839A

United States Patent [19]

Millward

[11] Patent Number: 6,151,839

[45] Date of Patent: Nov. 28, 2000

[54] COVER

[76] Inventor: Stanley Millward, Trees, Oakham Crescent, Dudley, West Midlands, United Kingdom, DY2 8AJ

[21] Appl. No.: 09/101,290

[22] PCT Filed: Jan. 9, 1997

[86] PCT No.: PCT/GB97/00058

§ 371 Date: Jul. 7, 1998

§ 102(e) Date: Jul. 7, 1998

[87] PCT Pub. No.: WO97/25496

PCT Pub. Date: Jul. 17, 1997

[30] Foreign Application Priority Data

Jan. 10, 1996 [GB] United Kingdom ..... 9600425

[51] Int. Cl.[7] ..... E04B 7/16

[52] U.S. Cl. ..... 52/66; 52/3; 52/DIG. 14; 52/72; 135/87; 135/157

[58] Field of Search ..... 52/66, 3, DIG. 14, 52/646, 72; 135/88.01, 905, 121, 157, 87

[56] References Cited

U.S. PATENT DOCUMENTS

| | | | |
|---|---|---|---|
| 2,847,720 | 8/1958 | Hamm | 52/66 |
| 2,853,745 | 9/1958 | Gipslis | 52/66 |
| 3,060,520 | 10/1962 | Schutmaat | 52/66 |
| 3,258,886 | 7/1966 | Button | 52/66 |
| 3,367,073 | 2/1968 | Seeger et al. | 52/66 |
| 3,438,158 | 4/1969 | Kane | 52/66 |
| 3,945,159 | 3/1976 | Girnus, Sr. | 52/66 |
| 3,949,528 | 4/1976 | Hartger et al. | 52/66 |
| 4,296,575 | 10/1981 | Verable et al. | 52/66 |
| 5,044,132 | 9/1991 | Harman | 52/66 |
| 5,414,966 | 5/1995 | Montoya . | |

FOREIGN PATENT DOCUMENTS

| | | |
|---|---|---|
| 2 695 357 | 3/1994 | France . |
| 28 34 690 | 2/1980 | Germany . |
| 511 724 | 10/1971 | Switzerland . |

*Primary Examiner*—Carl D. Friedman
*Assistant Examiner*—Dennis L. Dorsey
*Attorney, Agent, or Firm*—Nixon & Vanderhye P.C.

[57] ABSTRACT

A cover for a vehicle has a base at ground level and a rigid cover member having a downwardly facing mouth and movable between a lowered position and a raised position. A support is connected to and extend upwardly from the base and are arranged to support the cover member in its raised position. A resilient device is provided for urging the cover member to its raised position. In the lowered position, the mouth of the cover lies at ground level and defines with the base an enclosed storage area. In the raised position, both ends of the cover are raised above the base and access is permitted to the storage area.

20 Claims, 2 Drawing Sheets

FIG 1
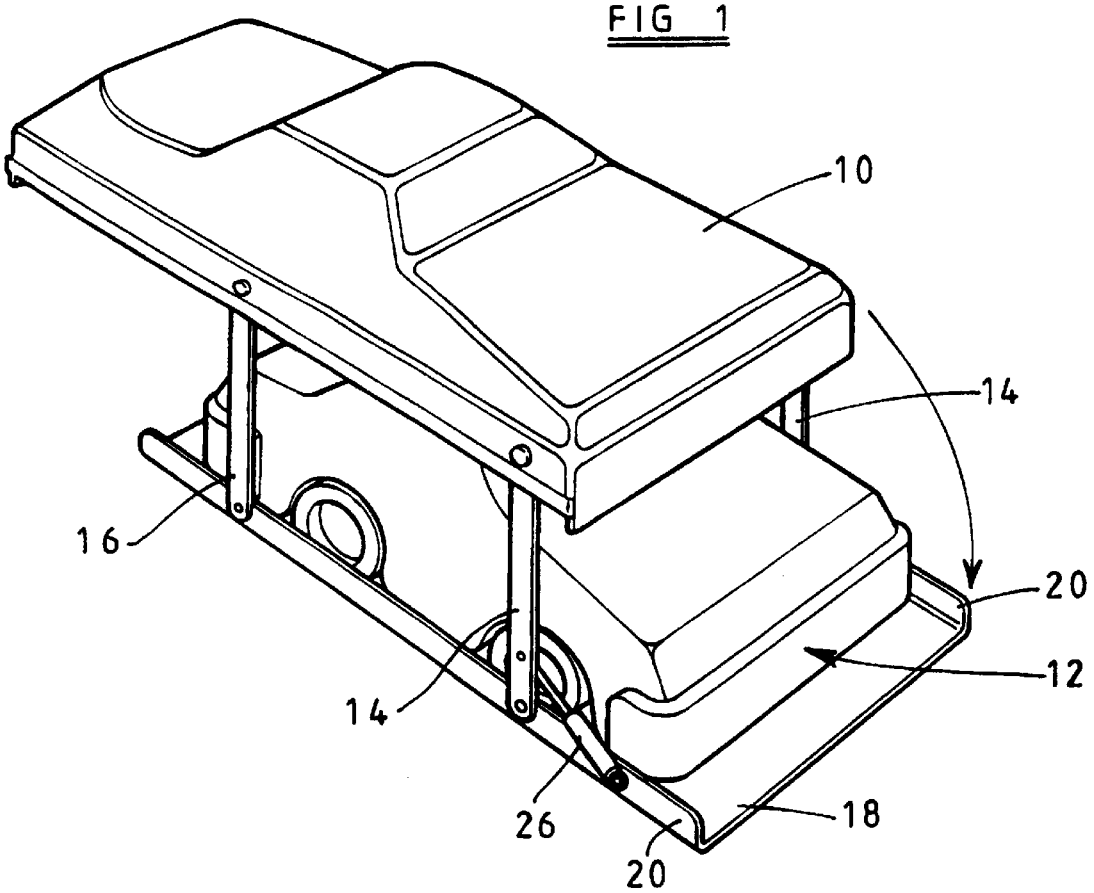
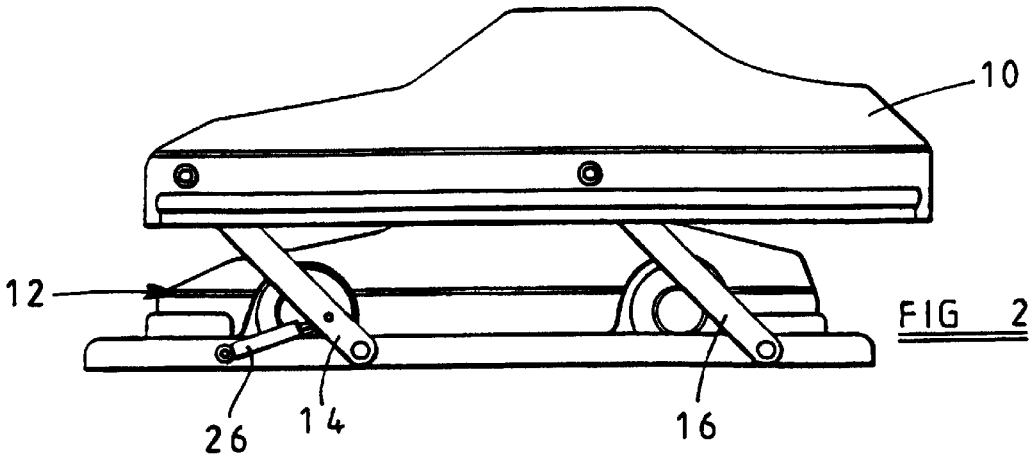
FIG 2
FIG 3
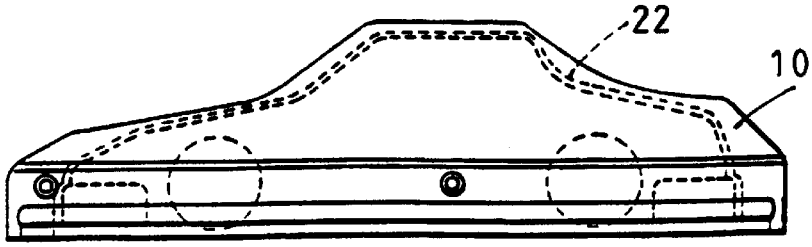

COVER

TECHNICAL FIELD

This invention relates to a cover suitable for use in providing a covered storage area for a motor car, motorcycle, boat or the like (hereinafter referred to for convenience as 'vehicles').

Vehicles stored outside without a cover are susceptible to dirt including bird droppings, to theft, to accidental impact damage and vandalism, and are exposed to ambient weather conditions.

BACKGROUND OF THE INVENTION

In order to provide protection for cars stored outside it is known to provide a flexible fabric cover carried by a plurality of rigid 'U' shaped frame members the free ends of the arms of which are pivotally interconnected. The frame members can be pivoted to a position in which they substantially align with one another usually lying on the ground, so that the vehicle is exposed and the arrangement does not occupy much space. By pivoting the frame members away from one another, the covering is spread out to form a tent-like structure which, if erected over a car, forms a temporary covering for the car. In order to use the car, the cover must be folded up which, if the cover is wet, may be an unpleasant task. Moreover such covers are not aesthetically pleasing and provide little protection against impact damage and virtually no security.

SUMMARY OF THE INVENTION

According to the present invention there is provided a vehicle cover comprising a rigid cover member movable between a lowered position in which the cover member defines a storage area, and a raised position in which access to the storage area is permitted, and means for supporting the cover member when the cover member is in its raised position. Conveniently the cover member is shaped externally to resemble a vehicle.

Preferably there is provided at least one, and desirably a plurality of legs connected to the cover member for supporting the cover member in its raised position.

Each leg may be defined by or may incorporate a generally vertically extensible ram.

Alternatively said legs are pivotally connected at one end to the cover member and pivotally connected at their other ends to an anchorage.

Desirably said legs define with the cover member a parallelogram linkage whereby the orientation of the cover is the same in the raised and lowered positions.

Preferably there is provided resilient means, conveniently in the form of one or more gas-struts or other air-springs, urging the cover member to its raised position.

Desirably said legs are generally L-shaped.

Preferably the cover includes means for varying the effective weight of the cover member/leg assembly above and below the counterbalancing effect of said resilient means so as to cause the cover member to move to its lowered position or to permit the resilient means to raise the cover member. Conveniently said means includes an arrangement for transferring, on demand, weight to and from the cover member and/or the legs.

Desirably said means includes a pump for transferring a liquid to a tank carried by the cover member/leg assembly to increase the weight thereof.

The cover member may be shaped such that the interior thereof substantially conforms with the exterior shape of an article intended to be stored in the storage area. It will be recognized that such shaping of the interior of the cover member permits the air gap between the cover member and the article to be reduced. The cover may be provided with air heating/cooling means. By minimizing the air gap between the article and cover member, the power requirement of the heater/cooler may be relatively low.

BRIEF DESCRIPTION OF THE DRAWINGS

The invention will further be described, by way of example, with reference to the accompanying drawings, in which:

FIG. 1 is a perspective view of a cover in accordance with an embodiment of the invention;

FIG. 2 is a side view of the cover with the cover member thereof in a part-raised position;

FIG. 3 is a diagrammatic side view with the cover member in a closed position;

DETAILS OF THE PREFERRED EMBODIMENTS

Figure 4:
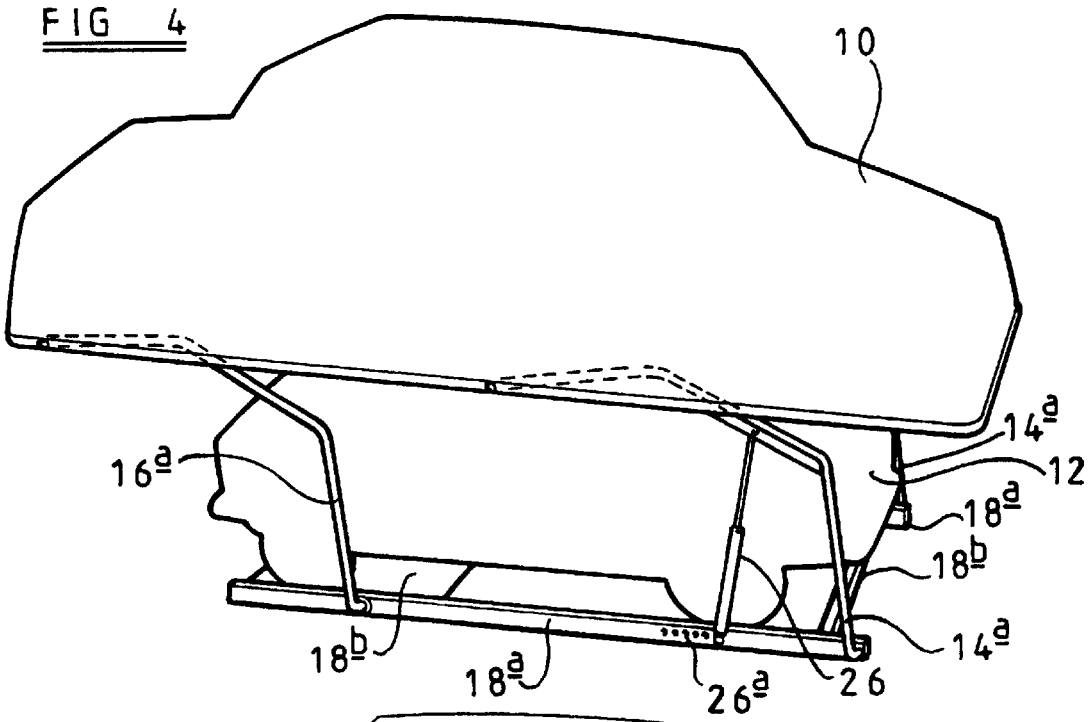
FIG. 4 is a view similar to FIG. 1 of a modification.

The cover illustrated in the accompanying drawings comprises a rigid cover member 10 the interior of which (see FIGS. 3 and 6) is shaped so as to conform, generally, with the shape of the exterior of a motor car 12. The cover member 10 may be constructed using any suitable material, for example by vacuum moulding a plastics material or using fibreglass, from one or more sheet metal pressings, or from a fabric or sheet plastics skin supported on a relatively rigid framework. It will be recognized that where the cover member is intended to be a close fit over the car then the interior of the cover member 10 does not conform exactly with the exterior shape of the car as in order to permit movement of the cover member 10 with respect to the car, elongate recesses will be required in the cover member 10 to allow for the presence of wing mirrors, door handles or other projections provided on the car body. Further, where the cover member 10 is arranged to follow an arcuate path, the recesses are shaped or dimensioned to take such movement into account. An increased clearance between cover member and car obviates the need for such internal shaping.

Referring first to FIGS. 1 to 3 the cover member 10 is pivotally connected to two pairs of legs 14, 16, the legs 14 being pivotally connected at one end to respective sides of cover member 10 adjacent the open, lower face thereof and inset from the opposite ends of the cover member. The other end of each of the legs 14, 16 is pivotally connected to a base 18.

The base 18 which is preferably anchored to the ground may comprise a channel section steel member the base wall of which is of width slightly smaller than the width of the cover member 10, the legs 14, 16 being pivotally connected, to the upstanding side walls 20 of the channel section. Alternatively the base 18 could be defined by two parallel L-section members spaced by two or more transverse metal strips.

Figure 5:
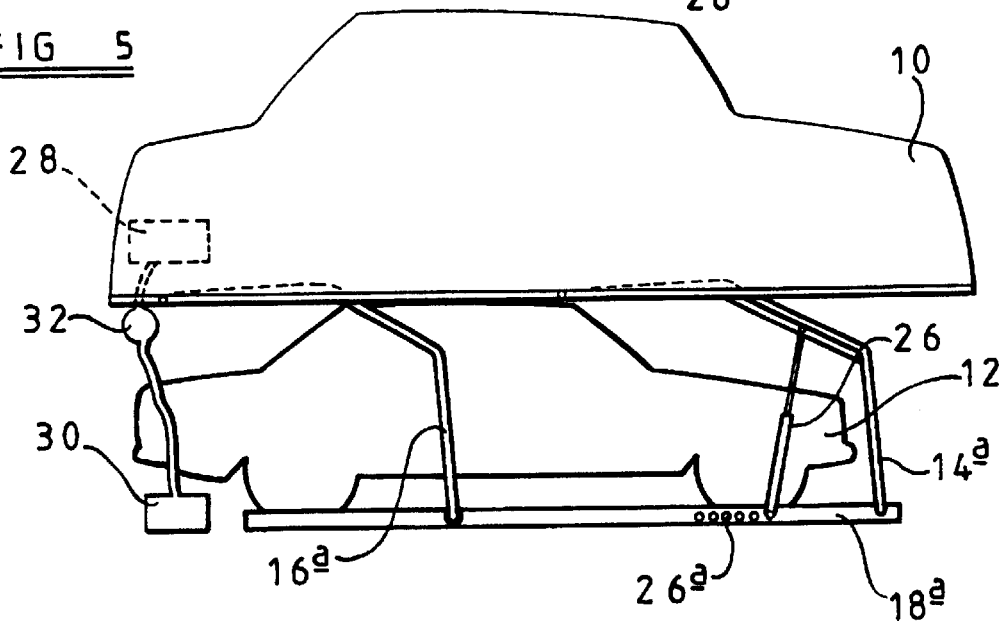
FIG. 5 is a side view of the modification of FIG. 4.
Figure 6:
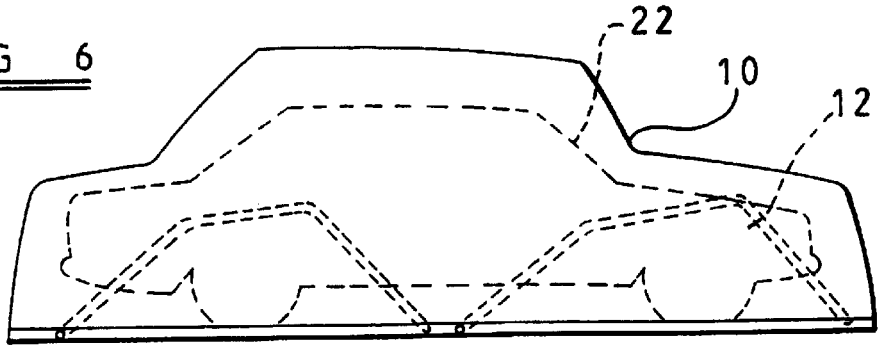
FIG. 6 is a view similar to FIG. 3 of the modification.

It will be noted that the legs 14, 16 in FIGS. 1 to 3 are rectilinear, and while such an arrangement is desirable for simplicity, there are applications in which an alternative leg arrangement of the kind illustrated in FIGS. 4, 5 and 6 is preferable. As is apparent from FIGS. 4 to 6 the legs 14*a*, 16*a* are generally L-shaped, the legs 14*a* being pivoted to the base 18 close to one end of the base, and having their opposite ends pivoted to the cover 10 substantially vertically aligned with the center of gravity of the cover 10. The other legs 16*a* are shaped identically to the legs 14*a* and are pivoted to the base 18 adjacent the opposite end of the base, and are pivoted to the cover 10 adjacent an end of the cover. As the legs 14*a* are pivoted to the cover 10 close to the center of gravity of the cover 10 then the legs 14*a* support substantially the whole of the weight of the cover 10 and the legs 16*a* act as guiding links during raising and lowering of the cover 10 relative to the base 18.

Although the base 18 can take any of the forms mentioned above in relation to FIGS. 1 to 3, it is convenient to form the base from a pair of parallel steel box sections 18*a* spaced apart by the width of the vehicle 12 and located relative to one another by transversely extending front and rear plates 18*b* welded to, or otherwise secured to, the box sections 18*a* and lying in facial contact with the ground in use. Any convenient bearing arrangement can be used pivotally to mount the legs 14*a*, 16*a* to the box sections 18*a*, but desirably the bearing arrangements will be adjustable to accommodate wear in use. The L-shaped nature of the legs 14*a*, 16*a* facilitates positioning of the legs so that at least the front doors of the vehicle 12 are unobstructed when the vehicle is driven beneath the cover 10, and also has the advantage that the longitudinal movement of the cover 10 relative to the base 18 during raising and lowering of the cover 10 is minimised by comparison with the rectilinear legs construction of FIGS. 1 through 3.

Referring now to both FIGS. 1 to 3 and 4 to 6, air spring arrangements 26 (also known as gas-struts) are connected between the walls 20 or box sections 18*a* and associated legs 14; 14*a* and/or legs 16; 16*a* to urge the legs to pivot to raise the cover member 10 from the base member 18, the air spring arrangements 26 counterbalancing the weight of the cover member 10. In practice it is probable that the air spring arrangements will be associated only with the legs 14 or 14*a* and as shown in FIGS. 4 and 5 will have alternative mounting points 26*a* on the base 18 (or if desired on the legs 14, 14*a*) to allow the force imposed on the legs by the arrangements 26 to be adjusted to suit different weights of member 10. The counterbalancing is preferably such that a small manual input is necessary to lift the member 10 away from the base 18, but if desired the counterbalancing could be such that the weight of the member 10 is overpowered and the cover 10 has a normally open position, latching being provided to hold the cover member in a closed position relative to the base. There may be applications where one or more of the legs is defined in part or completely by an air spring rather than having the spring as an adjunct to the leg.

In use, with the car 12 stored within the cover, it will be recognized that the car is stored in a clean, dry environment the presence of the rigid cover member 10 over the car 12 also improving the security of the car. The arrangement may be such that once the cover member 10 has been lifted manually beyond a predetermined distance, the air spring arrangements 26 are able to provide a sufficiently large force to continue moving the cover member 10 until the open position illustrated in FIG. 1 is reached. In this position, further movement of the cover member 10 is restricted due to the air spring arrangements 26 being fully extended and/or the provision of abutments, the force exerted by the air spring arrangements 26 in this position being sufficient to retain the cover member 10 in the raised position. In this position, the car 12 may be removed from the storage area defined by the cover member 10 and base 18 in the position illustrated in FIG. 3. The cover member 10 is then moved back to its lowered position, such movement requiring the user to apply only a sufficiently large force to overcome the force exerted by the air spring arrangements 26.

To return the car 12 and cover to the position illustrated in FIG. 3, the cover member 10 is moved to its raised position, the car 12 is carefully positioned within the storage area, and the cover member 10 returned to its lowered position.

FIG. 5 illustrates a modification applicable if desired to the construction in FIGS. 1 to 3, in which the cover member 10 or one of the legs carries a tank 28 into which liquid can be pumped from a ground based reservoir 30 by an electric pump 32. Operating the pump to pump liquid to the tank 28 increases the effective weight of the cover member 10 so overcoming the air springs 26 and allowing the cover member 10 to pivot on the legs 14, 16; 14*a*, 16*a* to its lowered position. Reversing the pump or opening an appropriate valve to return liquid from the tank 28 reduces the weight of the cover member 10 to allow it to be raised by the air springs 26. A fixed or portable remote switching arrangement can be provided for controlling the flow to and from the tank.

For added security, irrespective of how the cover member is to be moved a suitable locking mechanism may be incorporated into the base 18 and/or the cover member 10 to lock the cover member 10 is in its lowered position. Further, an alarm could be incorporated into the cover to sound an audible warning if an unauthorized attempt is made to raise the cover member 10.

Rather than use air spring arrangements 26, other types of resilient support means, for example mechanical springs or torsion bars, may be used to counterbalance some or all of the weight of the cover member and legs to urge the cover member towards its raised position. As a further alternative the movement of the cover member may be automated by the provision of an electrically powered drive arrangement such as a rack and pinion or a screw-jack instead of or in addition to the resilient counterbalance arrangement. Such a drive arrangement could be activated on releasing a key operated lock, or alternatively using, for example, an infrared remote control device, and may be capable of raising and lowering the cover member. In a modification the member 10 is supported on, or the legs 14 are movable by, extensible rams which may be hydraulic or mechanical. Where the cover member 10 is carried by the rams then preferably they will be disposed vertically to provide a vertical movement of the member 10.

The interior of the cover member 10 is conveniently shaped so as to conform, generally, to the exterior shape of the car 12, such shaping being denote by the dashed line 22 in FIG. 3. It will be recognized that such shaping reduces the volume of the air gap between the car 12 and cover member 10. Conveniently, an air heating and/or cooling device is provided in the cover member 10 or base 18, the device being of relatively low power but of sufficient power to control efficiently the temperature of the air within the air gap thus avoiding problems which may occur if the temperature of the car were to fall below, say, freezing point or rise above a comfortable temperature for subsequent use. The device may conveniently be controlled by a controller including a timer arranged to switch the device on at a predetermined time and switch it off after a suitable interval. Alternatively, a photo-detector could be provided to enable the device to be switched on at dawn, for example, or the drive could be controlled by one or more temperature sensors inside the cover member 10.

The air temperature control and/or alarm may be powered by an internal power source, for example a battery which may be connected to a photoelectric cell to permit solar charging of the battery. A blower for circulating air within the cover could also be provided.

Where the cover member 10 is shaped to conform to the shape of the car 12, it will be understood that accurate positioning of the car 12 within the storage area is necessary in order to avoid damage to the car 12 or cover on lowering the cover member 10. In order to aid such accurate positioning, longitudinal and lateral guide means may be provided. The guide means may take the form of a bar or bars rigidly secured to the base member 18 and positioned such that when the car 12 is correctly positioned, one or more of the car's tires engage the bar providing resistance to further movement of the car 12. Such resistance provides an indication that the car 12 is correctly positioned.

The base may incorporate supports or abutments which cooperate with one or more of the legs to define the limit of their movement in a raising direction, if desired the legs moving over-center immediately before cooperating with the abutments.

Rather than having side walls 20 or box sections 18*a*, the base 18 may be provided with individual brackets for pivotal connection to the legs 14, 16 and air spring arrangements 26, the brackets being located such that when the car is located in the storage area with the cover member 10 in its raised position, access to the car's doors is not obscured. Some form of motion damping may be applied to the legs 14, 16; 14*a*, 16*a* if desired, either by damping the pivotal movement in the respective bearings or by linking one or more damping strut between a leg and the base.

It is convenient to construct the cover member 10 to be of relatively uniform thickness, thus if the interior thereof is shaped to conform to the exterior shape of a car, the outer surface of the cover member 10 also resembles a car. It is envisaged that the cover member 10 may be decorated so as for example to look like the car which, in use, is to be stored within the cover or to provide corporate advertising. Moreover the periphery of the cover 10 may be provided with a flexible skirt which engages the ground or the base 18 in the lowered position to provide a seal around the periphery of the cover 10.

Rather than shape the cover member 10 for use with a specific model of car, it has been found that a single shape cover member 10 is suitable for use with a range of cars, thus a relatively small range of different cover members could be provided which permit storage of a wide range of motor cars. For example a single member 10 might suit all small hatchback cars while a second member suits all small booted cars.

Where the cover is intended for use in storing an electrically powered vehicle, the cover may be arranged to include suitable contacts to permit charging of the vehicle's batteries whilst the vehicle is stored within the cover. In one possible arrangement, a pair of spring bars are provided on the cover member or a bracket upstanding from the base and arranged to engage beneath the vehicle's bumper when the vehicle is correctly positioned within the cover, the spring bars being connected to a suitable electrical supply. Such an arrangement results in the vehicle being connected to the electrical supply automatically on positioning the vehicle within the cover, and does not require the vehicle's user to connect the plug of an electrical supply to a socket provided on the vehicle. In such an arrangement, the heater/blower arrangement and alarm system (if provided) may be powered from the same source as the charging arrangement, for example from a transformer/charger provided in an adjacent building. Where there is no electricity supply near the cover the contact arrangement on the base and the car can be used to power at least the raising mechanism of the cover.

Although the description and drawings relate to the use of the cover in the storage of a car, it is envisage that similar covers could be used to store motorcycles, boats (for example motor boats) or other articles to provide improved protection against dirt and moisture, and improved security.

Where the cover member is small, for example for a motor cycle, it is possible to hinge one end of the cover member to the base and to utilise a single pair of legs, or possibly a single leg, at the opposite end of the cover to support the cover member in its raised position. Each leg might be defined at least in part by an air spring or a ram or the like.

What is claimed is:

1. A vehicle cover comprising:

a base disposed at ground level;

a rigid cover member having a downwardly facing mouth, and two ends, said cover member being movable between a lower position and a raised position;

supporting means connected to at one end to said base, and extending upwardly therefrom and at the other end to said cover member for supporting said cover member in said raised position; and resilient means coupled at one end to said supporting means and at the other end to said base for urging said cover member to said raised position; and wherein in said lowered position said mouth of said cover member lies at ground level and defines with said base an enclosed storage area, and wherein in said raised position, both ends of said cover member are raised above said base and access is permitted to said storage area.

2. A cover as claimed in claim 1, wherein the supporting means comprises two or more legs whose upper ends are bent downwardly, said legs forming a linkage with the cover member, said linkage being completely collapsible.

3. A cover as claimed in claim 2 wherein the supporting means comprises two or more generally L-shaped legs, whereby at least the front doors of the vehicle are unobstructed when it is driven beneath the raised cover.

4. A cover as claimed in claim 2 wherein said linkage constitutes a parallelogram linkage.

5. A cover as claimed in claim 2, wherein the resilient means comprises a compression strut pivotally connected between a pivoted leg of the supporting means and a fixed pivot on the base member which is spaced apart from the pivot of said leg.

6. A cover as claimed in claim 5, wherein the compression strut is pivotally connected to an intermediate portion of a said leg which is upwardly offset from the line joining the pivots on the leg.

7. A cover as claimed in claim 1 wherein the cover member is shaped such that the interior thereof substantially conforms to the exterior shape of a vehicle to be stored.

8. A cover as claimed in claim 1 including means for heating or cooling air within the cover.

9. A cover as claimed in claim 1 including an electrically operable drive arrangement for raising the cover member.

10. A cover as claimed in claim 1 wherein the resilient means is connected between the base member and the supporting means and acts in compression to push the supporting means to an upright position.

11. A cover as claimed in claim 1 including means for varying the effective weight of the cover member above and below a position providing a counterbalancing effect of said resilient means so as to cause the cover member to move to its lowered position or to permit the resilient means to raise the cover member.

12. A cover as claimed in claim 11, wherein the weight varying means includes an arrangement for transferring, on demand, weight to and from the cover member and/or the legs.

13. A cover as claimed in claim 12, wherein the weight varying means includes a pump for transferring a liquid to a tank carried by the cover member/leg assembly to increase the weight thereof.

14. A vehicle cover comprising:

a base at ground level;

a rigid cover member having a downwardly facing mouth and two ends, and movable between a lowered position and a raised position;

a plurality of supporting legs each pivotally connected at one end to and extending upwardly from a lateral side of the base and pivotally connected at its other end to the corresponding side of the cover member to define a linkage with said cover member, said linkage being arranged to support the cover member in its raised position; and a resilient device coupled to said linkage to urge said cover member to said raised position; and wherein said linkage is completely collapsible so that in said lowered position, said mouth of said cover member lies at ground level and defines with said base an enclosed storage area, and wherein in said raised position, both ends of said cover member are raised above said base and access is permitted to said storage area.

15. A cover as claimed in claim 14 wherein the cover member is shaped such that the interior thereof substantially conforms to the exterior shape of a vehicle to be stored.

16. A cover as claimed in claim 14 including means for heating or cooling air within the cover.

17. A cover as claimed in claim 14 including means for varying the effective weight of the cover member above and below a position providing a counterbalancing effect of said resilient means so as to cause the cover member to move to its lowered position or to permit the resilient means to raise the cover member.

18. A cover as claimed in claim 14 wherein the resilient means is connected between the base member and the supporting means and acts in compression to push the supporting means to an upright position.

19. A vehicle cover as recited in claim 14 wherein said linkage comprises a parallelogram linkage.

20. A vehicle cover comprising:

a rigid cover member having a downwardly facing mouth and movable between a lowered position in which the cover member defines a storage area, and a raised position in which access to the storage area is permitted;

said cover member having supporting means extending upwardly from a base member and arranged to support said cover member when said cover member is in said raised position;

resilient means for urging said cover member towards its raised position; and means for varying the effective weight of said cover member above and below a position providing a counterbalancing effect of said resilient means so as to cause said cover member to move to said lowered position or to permit said resilient means to raise said cover member, said weight varying means includes a pump for transferring a liquid to a tank carried by said cover member to increase the weight thereof.

* * * * *